US005867985A

United States Patent [19]

Furuhashi et al.

[11] Patent Number: 5,867,985

[45] Date of Patent: Feb. 9, 1999

[54] EXHAUST MANIFOLD FOR ENGINE

[75] Inventors: Kazuhiro Furuhashi; Hirokazu Mori; Shuichi Nishizaki; Koichi Tanino; Masafumi Imasaka; Ichiro Moritake; Hirokazu Shirai, all of Shizuoka, Japan

[73] Assignee: Yutaka Giken Co. Ltd., Hamamatsu, Japan

[21] Appl. No.: 889,574

[22] Filed: Jul. 8, 1997

[30] Foreign Application Priority Data

Jul. 9, 1996 [JP] Japan ..... 8-179651

[51] Int. Cl.[6] ..... F01N 7/00; F16B 37/06

[52] U.S. Cl. ..... 60/323

[58] Field of Search ..... 60/323, 276, 272; 29/890.08

[56] References Cited

U.S. PATENT DOCUMENTS

| | | | |
|---|---|---|---|
| 4,930,678 | 6/1990 | Cyb . | |
| 5,148,675 | 9/1992 | Inman | 60/323 |
| 5,349,817 | 9/1994 | Bekkering . | |
| 5,572,868 | 11/1996 | Okamotoet al. | 60/323 |
| 5,636,515 | 6/1997 | Matsumoto et al. | 60/323 |
| 5,682,741 | 11/1997 | Augustin et al. | 60/272 |

FOREIGN PATENT DOCUMENTS

| | | |
|---|---|---|
| 3333591A1 | 3/1985 | Germany . |
| 19505710A1 | 8/1995 | Germany . |
| 19511514C1 | 8/1996 | Germany . |
| 55-122983 | 2/1954 | Japan . |
| 6-31140 | 8/1994 | Japan . |

*Primary Examiner*—Marguerite McMahon

*Attorney, Agent, or Firm*—Nikaido, Marmelstein, Murray & Oram LLP

[57] ABSTRACT

An exhaust manifold for an engine includes a manifold body 7 having a plurality of branch pipes and a common collecting chamber integrally connected to the branch pipes and communicating with an exhaust emission control device is divided into an upper half and a lower half at a boundary face extending in a direction of arrangement of the branch pipes. The upper and lower halves are made of steel plates and welded to each other. In the exhaust manifold, a welding mating coupler is formed by outer edges of the upper and lower halves, and a welding stepped superposing coupler is formed by inner edges of the upper and lower halves. Thus, during welding, it is possible to limit the misalignment of the upper and lower halves in a direction along the boundary face and the misalignment of the upper and lower halves in a direction perpendicular to the boundary face by cooperation of the mating coupler and the stepped superposing coupler. In addition, because the stepped superposing coupler is used for coupling of inner edges of the upper and lower halves to each other, it is possible to ensure sufficient clearances between the adjacent branch pipes, and to easily conduct the operation of mounting of the exhaust manifold to the engine by utilizing the clearances.

7 Claims, 11 Drawing Sheets

FIG.11
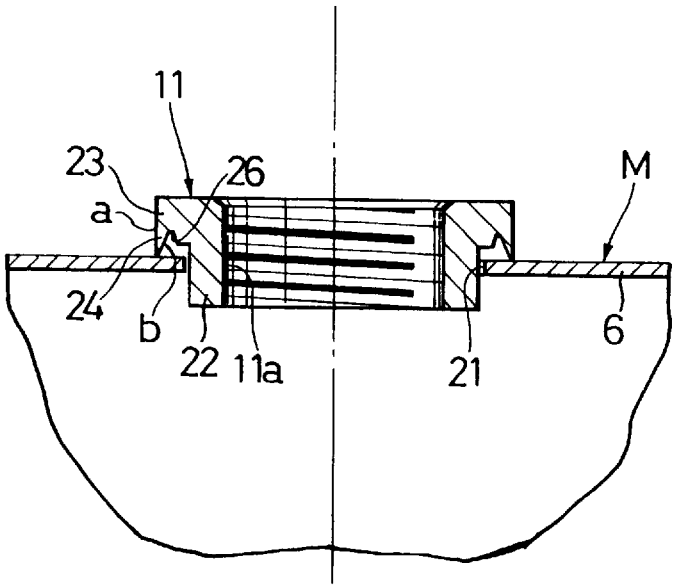
FIG.12-1
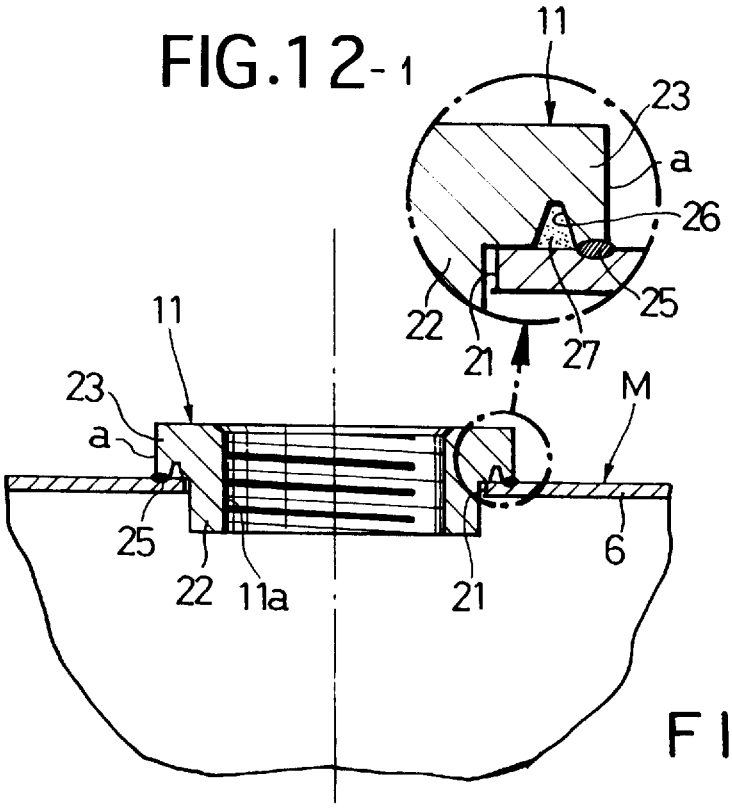
FIG.12

EXHAUST MANIFOLD FOR ENGINE

BACKGROUND OF THE INVENTION

1. Field of the Invention

The present invention relates to an exhaust manifold for an engine, which is connected to a cylinder head of the engine for guiding an exhaust gas discharge out of a combustion chamber, and particularly, to an improvement in a manifold for an engine, including a manifold body which is comprised of a plurality of branch pipes and a common collecting chamber integrally connected to the branch pipes and communicating with an exhaust emission control device, the body being divided into an upper half and a lower half at a boundary face extending in a direction of arrangement of the branch pipes, the upper and lower halves being made of steel plates and welded to each other.

2. Description of the Related Art

In such a conventional exhaust manifold, a welding mating coupler is formed by the entire opposed edges of the upper and lower halves, for example, as disclosed in FIG. 6 of Japanese Utility Model Registration Publication No. 6-31140.

In the exhaust manifold having the above structure, a measure to limit any misalignment between the upper and lower halves in the direction of arrangement of the branch pipes is not taken. For this reason, in some cases, the halves may be misaligned from each other in the direction of arrangement of the branch pipes during welding in some cases and hence, it is difficult to efficiently produce an exhaust manifold with a small manufacture error. In addition, the mating coupler existing at opposed surfaces of adjacent branch pipes largely narrows a clearance between the adjacent branch pipes, resulting in a disadvantage that the mounting operation is impeded thereby, which operation involves coupling the exhaust manifold to the cylinder head by utilizing the clearance as a working space and the like.

SUMMARY OF THE INVENTION

Accordingly, it is an object of the present invention to provide an exhaust manifold for an engine, which has only a small manufacture error, if any and is excellent for a mass production, and in which a sufficient clearance can be ensured between adjacent branch pipes.

To achieve the above object, according to a first aspect and feature of the present invention, there is provided an exhaust manifold for an engine, comprising a manifold body which is comprised of a plurality of branch pipes and a common collecting chamber integrally connected to the branch pipes and communicating with an exhaust emission control device, said manifold body being divided into an upper half and a lower half at a boundary face extending in a direction of arrangement of the branch pipes, the upper and lower halves being made of respective steel plates and welded to each other, wherein a welding mating coupler is formed by opposed outer edges of the upper and lower halves which are located at outermost positions in said direction of arrangement of the branch pipes, and a welding stepped superposing coupler is formed by opposed inner edges of the upper and lower halves facing each of clearances between adjacent ones of the branch pipes.

With the first feature of the present invention, the misalignment of the upper and lower halves in a direction along the boundary face and the misalignment of the upper and lower halves in a direction perpendicular to the boundary face can be limited during the welding by cooperation of the mating coupler with the stepped superposing coupler. Thus, it is possible to enhance the manufacture accuracy and the mass productivity of the exhaust manifold. In addition, since the stepped superposing coupler is used for coupling of the inner edges of the upper and lower halves to each other, it is possible to ensure a sufficient clearance between the adjacent branch pipes and to easily conduct the operation for mounting the exhaust manifold to the engine by utilizing the clearance.

According to a second aspect and feature of the present invention, in addition to the first feature, paddle-like reinforcing portions are formed on the manifold body to extend between and connect the adjacent branch pipes, wherein opposed wall surfaces of the upper and lower halves forming the reinforcing portions are disposed in proximity to each other at a distance such that they do not come into contact with each other even by a vibration.

With the second feature of the present invention, even if the exhaust manifold is vibrated under reception of the pulsing of the pressure therein and/or the vibration of the engine, the generation of a chattering at the reinforcing portions can be prevented. Moreover, each of the reinforcing portions exhibits a constricting effect on the adjacent branch pipes, and the effective length of each of the branch pipes cannot be changed unintendedly. Further, the depth of constriction of each reinforcing portion is decreased by an amount corresponding to the fact that the opposed wall surfaces are not in contact with each other at each of the reinforcing portions and hence, it is possible to facilitate the formation of the upper and lower halves by pressing and to contribute to a reduction in cost.

Further, according to a third aspect and feature of the present invention, in addition to the first or second feature, an exhaust gas sensor is mounted to the collecting chamber for detecting a concentration of a component in an exhaust gas flowing through an inside of the collecting chamber, and all the branch pipes are formed so that their axes join together at one point within the collecting chamber, the exhaust gas sensor having a detecting portion disposed at the one point.

With the third feature of the present invention, even in the collecting chamber defined to have a relatively small volume, a concentration of a component in all the exhaust gas, e.g., an average concentration of $O_2$ can be accurately detected by the exhaust gas sensor, and the activation of the exhaust gas sensor can be promoted. In addition, by the reduction in volume of the collecting chamber, the dropping in the temperature of the exhaust gas flowing from the exhaust manifold to the exhaust emission control device can be minimized to the utmost, thereby promoting an exhaust purifying reaction in the exhaust emission control device.

According to a fourth aspect and feature of the present invention, in addition to the third feature, at least some of the branch pipes are curved so that downstream ends of the pipes are met at one point, and at an inner wall of each of the curved branch pipes, a downstream portion is offset toward a center of a flow path in the pipe with respect to an upstream portion with an inclined portion interposed therebetween.

With the fourth feature of the present invention, the lengths of those portions of the flow path in the curved pipe on the inner and outer sides in the direction of the curve can be equalized to each other to the utmost, thereby diminishing the difference between the flow speed of the exhaust gas in the inner portion of the flow path and the flow speed of the exhaust gas in the outer portion of the flow path. Thus, it is possible to more accurately detect the concentration of a component in the exhaust gas flowing the branch pipes by the exhaust gas sensor.

Yet further, according to a fifth aspect and feature of the present invention, in addition to the first, second or third feature, the exhaust manifold further includes a sensor mounting boss which is comprised of a smaller-diameter cylindrical portion positioned and fitted in a mounting bore provided in the manifold body, and a larger-diameter cylindrical portion which is coaxially, integrally connected to the smaller-diameter cylindrical portion and projection-welded at a lower surface thereof to an outer surface of the manifold body, wherein an exhaust gas sensor mounting threaded bore is provided through central portions of the smaller-diameter and larger-diameter cylindrical portions, and a projection-welding annular projection having an acute apical angle θ and defined in a lower surface of the larger-diameter cylindrical portion by an outer peripheral surface of the larger-diameter cylindrical portion and a tapered surface extending upwards from a lower end of the outer peripheral surface toward the center of the larger-diameter cylindrical portion.

With the fifth feature of the present invention, if the sensor mounting boss is projection-welded to the exhaust manifold, an annular weld zone formed between them is to be located at an outer peripheral edge of the sensor mounting portion, and when an air leakage portion is produced in the annular weld zone, this leakage portion can be repaired extremely easily and reliably by a partial padding. Moreover, a thermal strain of the annular weld zone into the threaded bore due to welding heat can be decreased by the fact that the annular weld zone is located at the outer peripheral edge of the sensor mounting boss. As a result, it is possible to increase the diameter of the threaded bore and decrease the diameter of the entire sensor mounting boss and moreover, to provide an inexpensive exhaust manifold having a sensor mounting boss, which has a high air-tightness at the annular weld zone and moreover, in which the partial repairing can be simply performed.

Yet further, according to a sixth aspect and feature of the present invention, in addition to the fifth feature, the apical angle θ of the annular projection is in a range of 20° to 70°.

With the sixth feature of the present invention, the melting of the annular projection can be produced with a welding current having a relatively low value and as a result, it is possible to simultaneously provide an air-tightness at the annular weld zone and a reduction in consumption of an electric power.

Yet further, according to a seventh aspect and feature of the present invention, in addition to the sixth feature, the larger-diameter cylindrical portion has an annular recessed groove provided in its lower surface adjacent the inside of the annular projection.

With the seventh feature of the present invention, a molten slag produced from the annular projection can be accommodated in the recessed groove and prevented from entering the threaded bore.

The above and other objects, features and advantages of the invention will become apparent from the following description of the preferred embodiments taken in conjunction with the accompanying drawings.

BRIEF DESCRIPTION OF THE DRAWINGS

FIG. 11 is a vertical sectional view of a sensor mounting boss according to another embodiment before a projection-welding;

9

Figure 13:
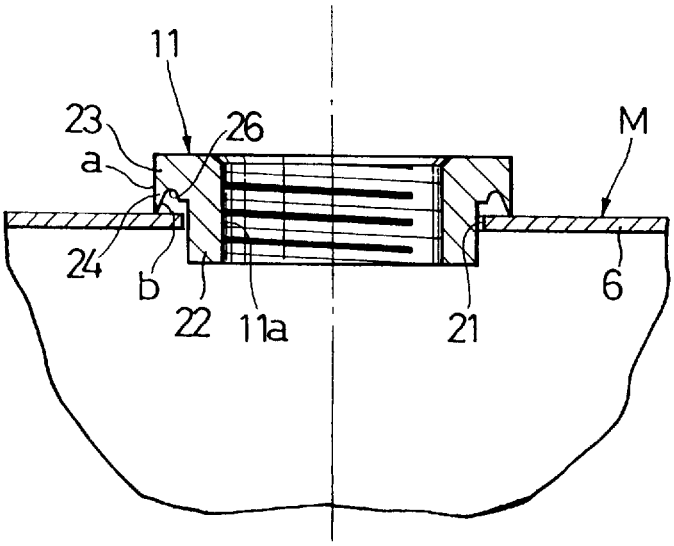
Figure 14:
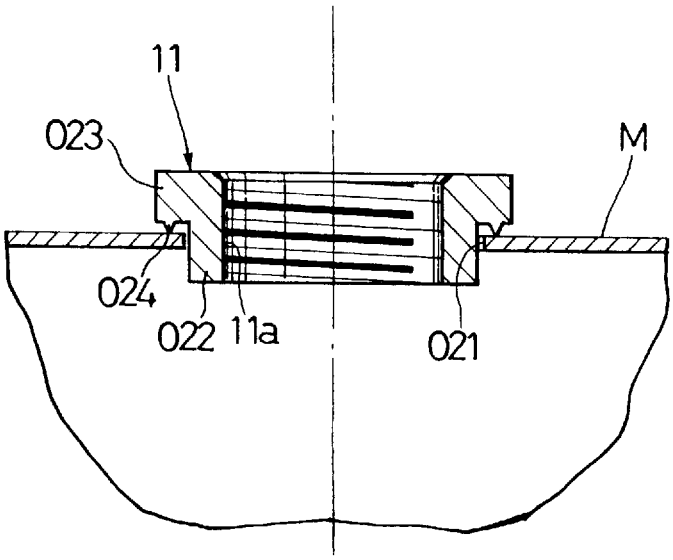
Figure 15:
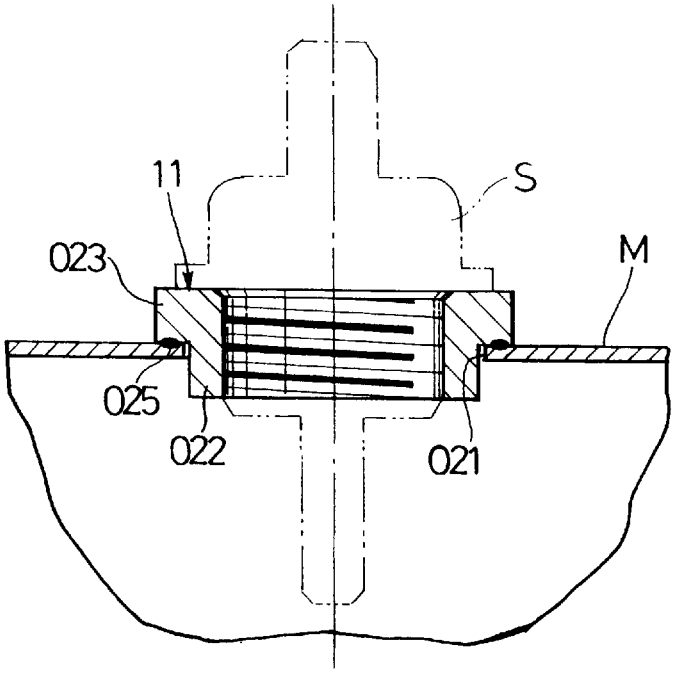

FIG. 12 is a vertical sectional view of the sensor mounting boss after the projection-welding;

FIG. 13 is a vertical sectional view of a sensor mounting boss according to a further embodiment before a projection-welding;

FIG. 14 is a vertical sectional view of a sensor mounting boss according to a comparative example before a projection-welding; and FIG. 15 is a vertical sectional view of the sensor mounting boss shown in FIG. 14 after the projection-welding.

DETAILED DESCIPTION OF THE PREFERRED EMBODIMENTS

The present invention will now be described by way of particular embodiments with reference to the accompanying drawings.

Figure 1:
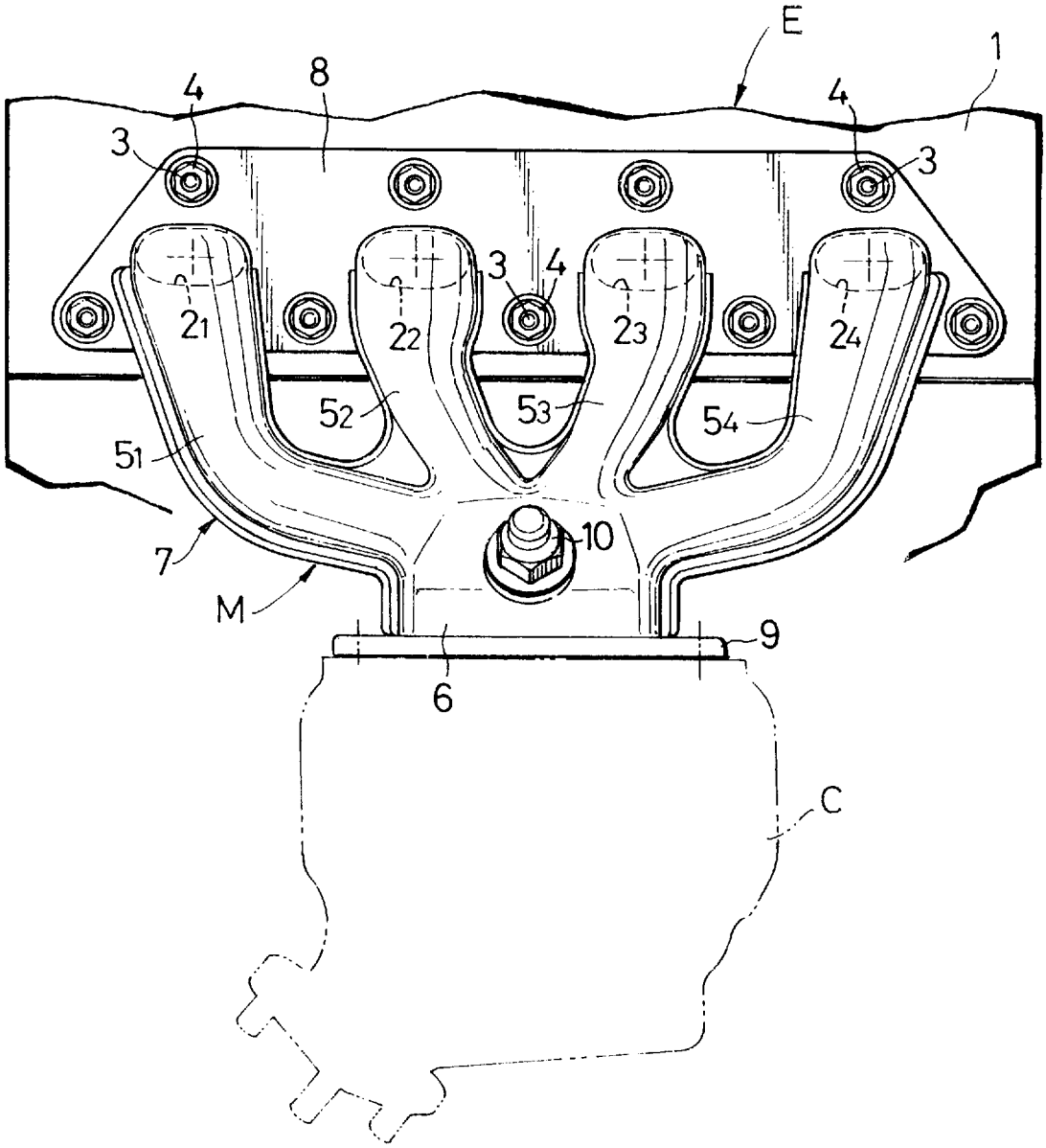
FIGS. 1 and 2 are a front view and a side view of an engine equipped with an exhaust manifold according to an embodiment of the present invention, respectively.
Figure 2:
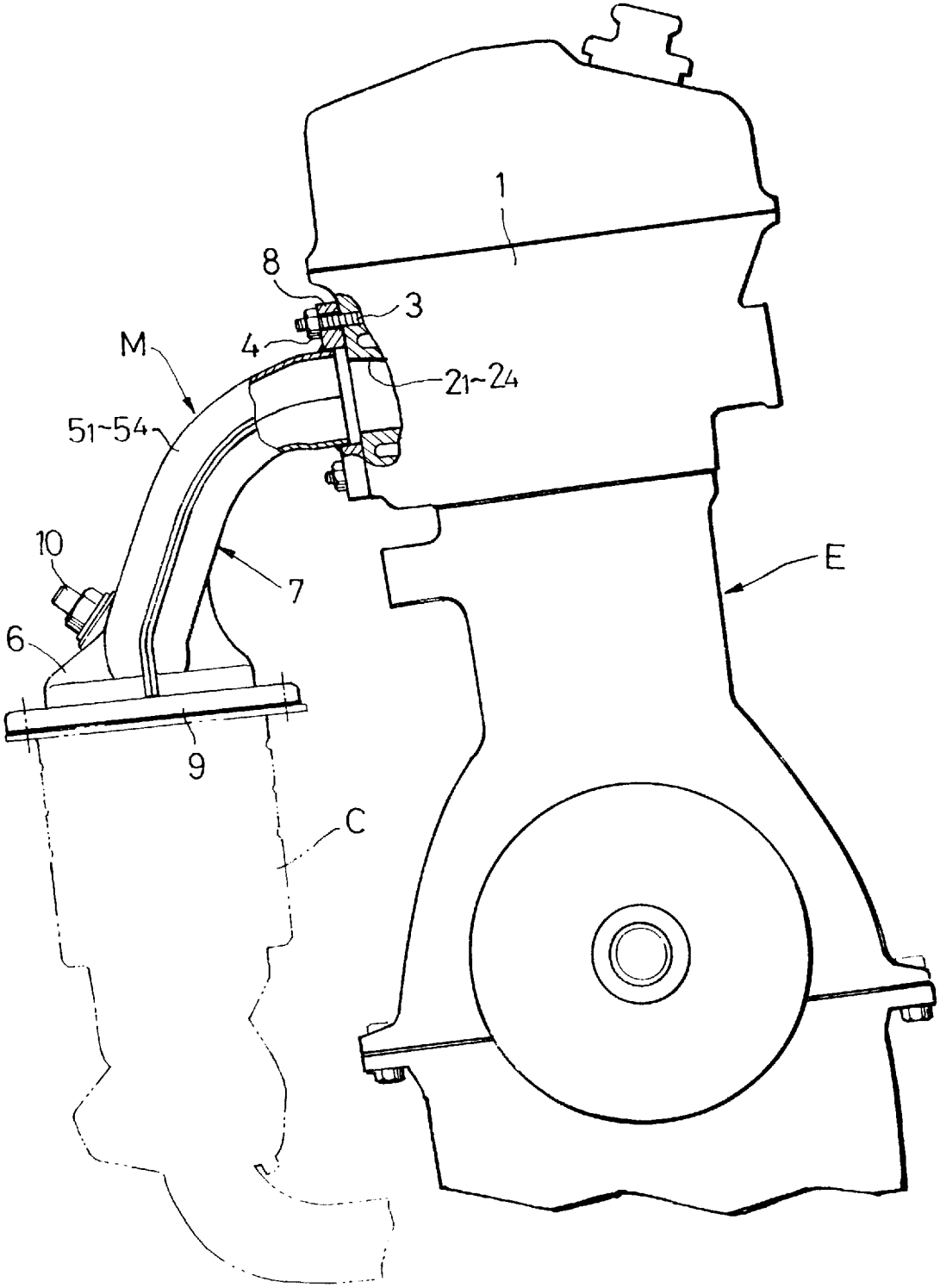

Referring first to FIGS. 1 and 2 showing a first embodiment, a plurality of (four in the illustrated embodiment) exhaust ports $\mathbf{2}_1$, $\mathbf{2}_2$, $\mathbf{2}_3$ and $\mathbf{2}_4$ open into a front surface of a cylinder head 1 of an engine E. An exhaust manifold M is mounted to the cylinder head 1 by a plurality of stud bolts 3, 3 and nuts 4, 4 for introducing an exhaust gas discharged from the exhaust ports into a common catalytic converter C (an exhaust emission control device).

Referring to FIGS. 3 to 7, the exhaust manifold M includes a manifold body 7 comprised of four branch pipes $\mathbf{5}_1$ to $\mathbf{5}_4$ individually communicating with the four exhaust ports $\mathbf{2}_1$ to $\mathbf{2}_4$, a common collecting chamber 6 integrally communicating with downstream ends of the branch pipes $\mathbf{5}_1$ to $\mathbf{5}_4$, and a paddle-like reinforcing portions $\mathbf{10}_1$ to $\mathbf{10}_3$ each extending between adjacent ones of the branch pipes $\mathbf{5}_1$, $\mathbf{5}_2$, $\mathbf{5}_3$, $\mathbf{5}_4$ to connect the adjacent branch pipes $\mathbf{5}_1$, $\mathbf{5}_2$, $\mathbf{5}_3$, $\mathbf{5}_{49}$; a first flange plate 8 welded to upstream ends of the branch pipes $\mathbf{5}_1$, $\mathbf{5}_2$, $\mathbf{5}_3$ and $\mathbf{5}_4$; and a second flange plate 9 welded to an outlet end of the collecting chamber 6. The branch pipes $\mathbf{5}_1$, $\mathbf{5}_2$, $\mathbf{5}_3$ and $\mathbf{5}_4$ extending from a front surface of the first flange plate 8 disposed substantially vertically are curved downwards toward the second flange plate 9 disposed substantially horizontally. A sensor mounting boss 11 is mounted to the collecting chamber 6 for mounting an exhaust gas sensor S.

Figure 3:
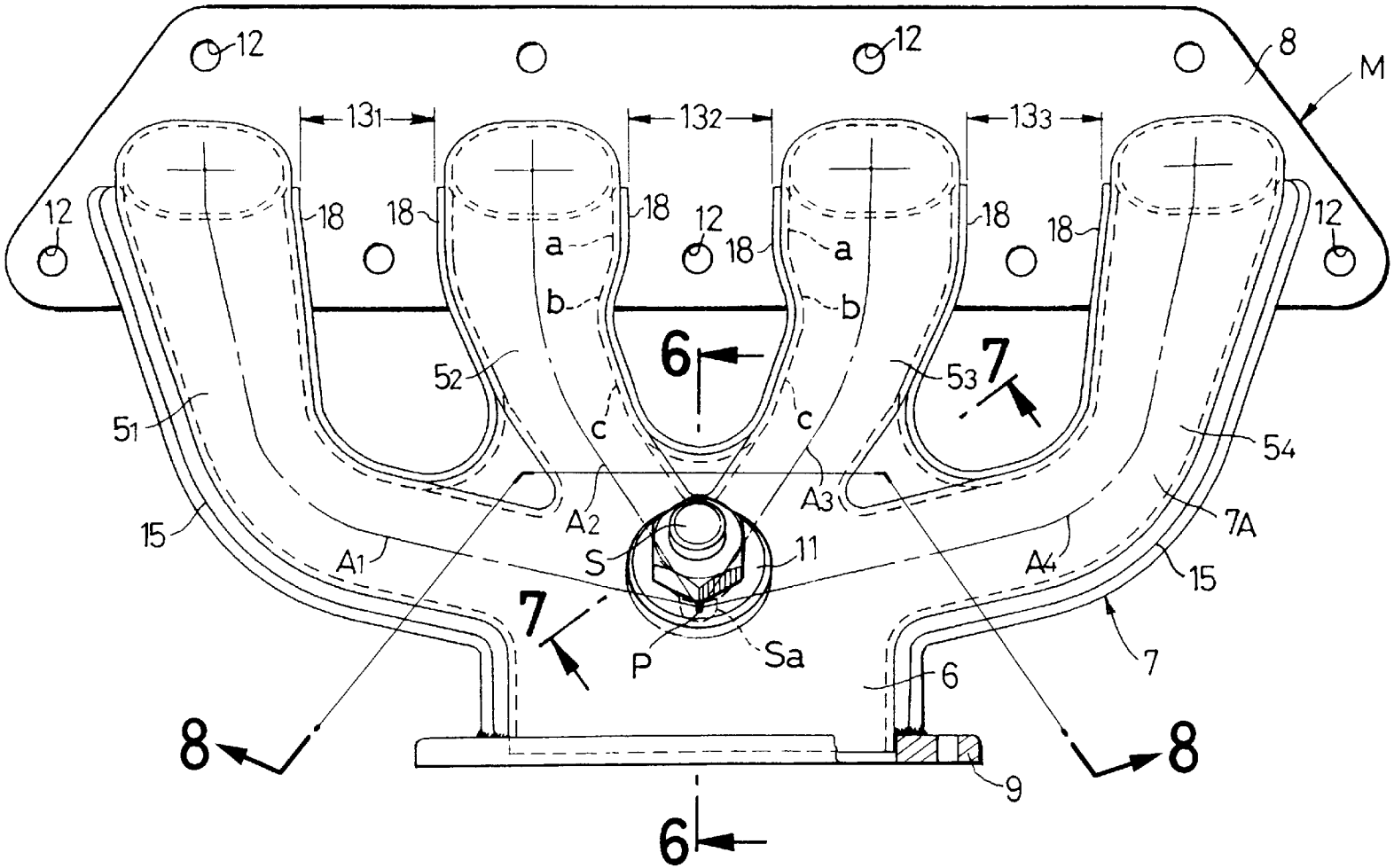
FIGS. 3 and 4 a front view and a side view of the exhaust manifold, respectively.

A large number of mounting bores 12, 12 are provided in the first flange plate 8 to surround the upstream ends of the branch pipes $\mathbf{5}_1$, $\mathbf{5}_2$, $\mathbf{5}_3$ and $\mathbf{5}_4$. Particularly, the mounting bore 12 located at a lower and intermediate position is disposed to face each of clearances $\mathbf{13}_1$, $\mathbf{13}_2$ and $\mathbf{13}_3$ between the adjacent branch pipes $\mathbf{5}_1$, $\mathbf{5}_2$, $\mathbf{5}_3$, $\mathbf{5}_4$, as shown in FIG. 3. The first flange plate 8 is secured to a front surface of the cylinder head 1 by inserting the stud bolts 3, 3 protruding on a front surface of the cylinder head 1 through the mounting bores 12, 12 and threadedly fitting the nuts 4, 4 over the stud bolts 3, 3.

The second flange plate 9 is used for connection with the catalytic converter C.

The manifold body 7 is divided into an upper half 7A and a lower half 7B at a boundary face 14 including axes $A_1$, $A_2$, $A_3$ and $A_4$ of the four branch pipes $\mathbf{5}_1$, $\mathbf{5}_2$, $\mathbf{5}_3$ and $\mathbf{5}_4$. Each of the halves 7A and 7B is made by pressing of a steel plate used as a blank.

Upon the pressing, a stepped mating coupler 15 is formed by opposed outer edges of the halves 7A and 7B located at an outermost position in a direction of disposition of the branch pipes $\mathbf{5}_1$, $\mathbf{5}_2$, $\mathbf{5}_3$ and $\mathbf{5}_4$. Specifically, the mating coupler 15 is comprised of an upper flange 16 protruding outwards from each of the outer edges of the upper halve 7A along the boundary face 14, and a lower flange 17 protruding outwards from each of the outer edges of the lower half 7B and mated to the upper flange 16. These flanges 16 and 17 are welded to each other.

A stepped superposing coupler 18 is formed by opposed inner edges of the halves 7A and 7B facing each of the clearances $\mathbf{13}_1$, $\mathbf{13}_2$ and $\mathbf{13}_3$ between the adjacent branch pipes $\mathbf{5}_1$, $\mathbf{5}_2$, $\mathbf{5}_3$, $\mathbf{5}_4$. Specifically, the stepped superposing coupler 18 is comprised of a straight coupler piece 19 rectilinearly extending from each of inner edges of the upper half 7A in a direction perpendicular to the boundary face 14, and a stepped coupler piece 20 risen to engage an outer surface of the straight coupler piece 19 while forming a step 20*a* extending outwards from each of the inner edges of the lower half 7B. These coupler pieces 19 and 20 are welded to each other.

With the mating couplers 15, 15 formed at the outer edges of the upper and lower halves 7A and 7B upon the above-described welding, the misalignment in the direction perpendicular to the boundary face 14 between the halves 7A and 7B is limited by the superposition of the upper and lower flanges 16 and 17. With the stepped superposing couplers 18 formed at the inner edges of the upper and lower halves 7A and 7B, the misalignment in a direction along the boundary face 14 between the halves 7A and 7B is limited by engagement of the straight coupler piece 19 and the stepped coupler piece 20 with each other. Thus, it is possible to easily produce the manifold body 7 made of the steel plate with an extremely small manufacture error.

The coupler facing each of the clearances $\mathbf{13}_1$, $\mathbf{13}_2$ and $\mathbf{13}_3$ between the adjacent branch pipes $\mathbf{5}_1$, $\mathbf{5}_2$, $\mathbf{5}_3$, $\mathbf{5}_4$ is the stepped superposing coupler 18 protruding sideways in an extremely small amount and hence, the amount of each clearance $\mathbf{13}_1$, $\mathbf{13}_2$, $\mathbf{13}_3$ narrowed by the coupler 18 is extremely small. Therefore, in mounting the first flange plate 8 to the cylinder head 1, the mounting operation can be easily carried out, for example, by inserting a tool into each clearance $\mathbf{13}_1$, $\mathbf{13}_2$, $\mathbf{13}_3$ without being obstructed by the coupler 18, and threadedly fitting the nut 4.

Figure 7:
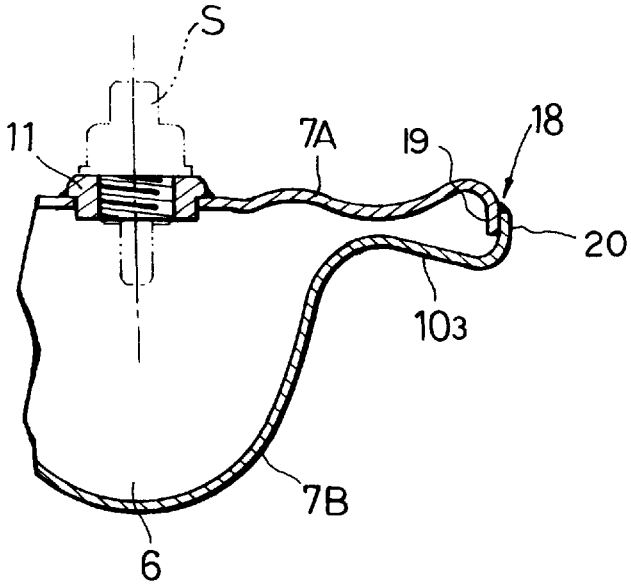
Figure 8:
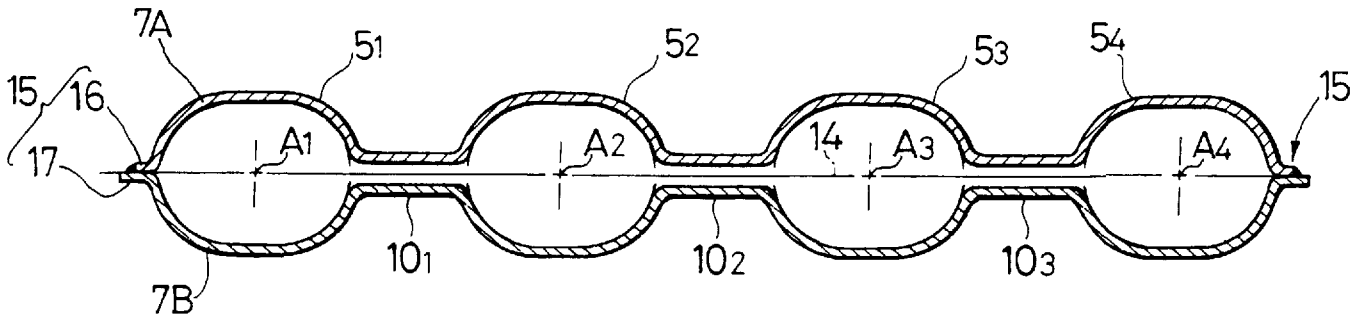
FIG. 8 is a sectional view taken along a line 8—8 in FIG. 3.

As shown in FIGS. 7 and 8, the paddle-like reinforcing portions $\mathbf{10}_1$, $\mathbf{10}_2$ and $\mathbf{10}_3$ are formed, so that the opposed wall surfaces of the upper and lower halves 7A and 7B is possibly in proximity to each other in a range such that they do not come into contact with each other, even if they are vibrated.

Therefore, even if the manifold body 7, particularly, the reinforcing portions $\mathbf{10}_1$, $\mathbf{10}_2$ and $\mathbf{10}_3$ are vibrated under reception of the pulsing of the pressure of the exhaust gas within the exhaust manifold M and/or the vibration of the engine E, a chattering due to the contact of the opposed wall surfaces cannot be produced at the reinforcing portions $\mathbf{10}_1$, $\mathbf{10}_2$ and $\mathbf{10}_3$. Moreover, the opposed wall surfaces of the reinforcing portions $\mathbf{10}_1$, $\mathbf{10}_2$ and $\mathbf{10}_3$ exhibit a constricting effect on the branch pipes $\mathbf{5}_1$, $\mathbf{5}_2$, $\mathbf{5}_3$ and $\mathbf{5}_4$ which are sufficiently in proximity to and adjacent one another and hence, the effective length of the branch pipes $\mathbf{5}_1$, $\mathbf{5}_2$, $\mathbf{5}_3$ and $\mathbf{5}_4$ cannot be shortened by the reinforcing portions $\mathbf{10}_1$, $\mathbf{10}_2$ and $\mathbf{10}_3$.

Further, in the reinforcing portions $\mathbf{10}_1$, $\mathbf{10}_2$ and $\mathbf{10}_3$, the depth of reinforcing portions $\mathbf{10}_1$, $\mathbf{10}_2$ and $\mathbf{10}_3$ constricted upon the formation of the upper and lower halves 7A and 7B by the pressing is decreased by an amount corresponding to the fact that the opposed wall surfaces are not in contact with each other. This facilitates the formation the halves by the pressing to contribute to a reduction in cost.

Figure 4:
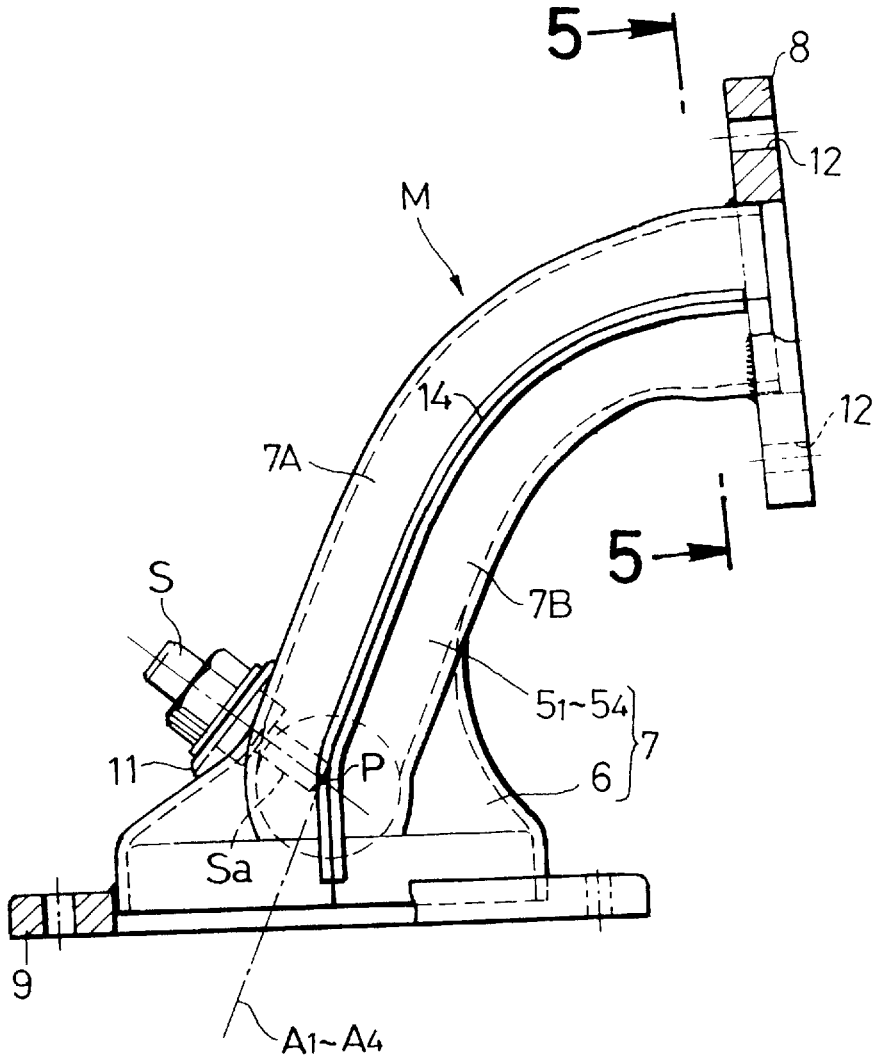
Figure 5:
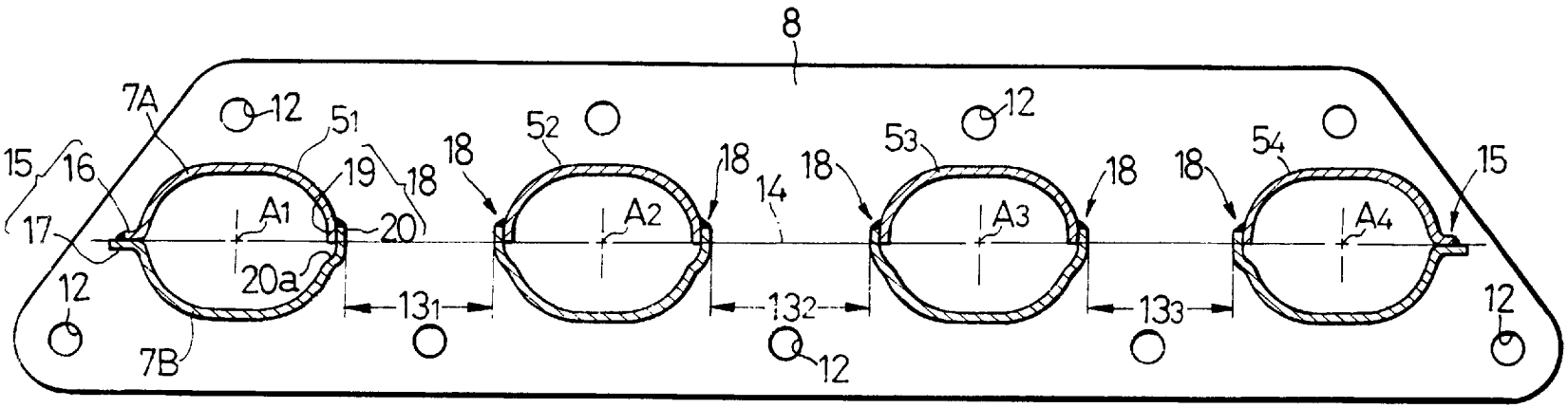
FIG. 5 is a sectional view taken along a line 5—5 in FIG. 4.
Figure 6:
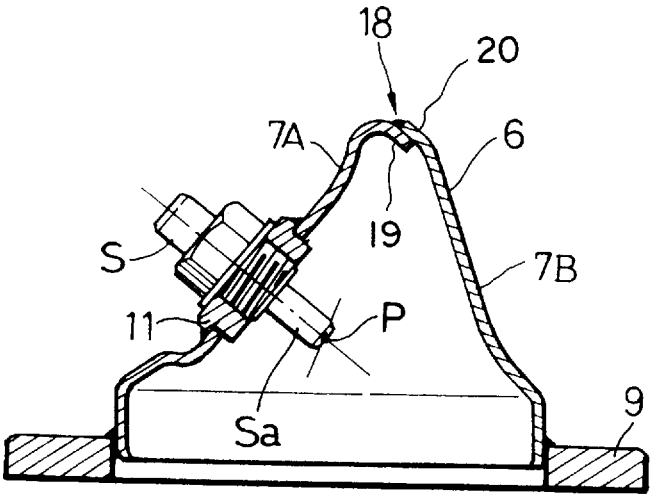
FIGS. 6 and 7 are sectional views taken along lines 6—6 and 7—7 in FIG. 3.

As best shown in FIGS. 3 and 4, all the four branch pipes $\mathbf{5}_1$, $\mathbf{5}_2$, $\mathbf{5}_3$ and $\mathbf{5}_4$ are formed, so that their axes $A_1$, $A_2$, $A_3$ and $A_4$ intersect together at one point P within the collecting chamber 6 (desirably, at the center within the collecting chamber 6). A detecting portion Sa of the oxygen ($O_2$) sensor S as an exhaust gas sensor mounted to the mounting boss 11 fixedly mounted on the upper wall of the collecting chamber 6 is disposed at the one point P.

Referring again to FIG. 3, the two inner branch pipes $\mathbf{5}_2$ and $\mathbf{5}_3$ as well as the two outer branch pipes $\mathbf{5}_1$ and $\mathbf{5}_4$ are of symmetric shapes and hence, the branch pipes $\mathbf{5}_1$, $\mathbf{5}_2$, $\mathbf{5}_3$ and $\mathbf{5}_4$ are curved so that their downstream ends extend toward the one point P. In this case, in order to ensure that the length of an outer portion of a flow path in each of the branch pipes $\mathbf{5}_1$, $\mathbf{5}_2$, $\mathbf{5}_3$ and $\mathbf{5}_4$ in a direction of the curve and the length of an inner portion of the flow path in the direction of the curve are equal-to each other to the utmost, the wall surface of each of the two inner branch pipes $\mathbf{5}_2$ and $\mathbf{5}_3$ which is inner in the direction of the curve, is formed so that a downstream portion c thereof is offset to the center of the flow path with the respect to an upstream portion a with an inclined portion b interposed therebetween, and the wall surface of each of the two outer branch pipes $\mathbf{5}_1$ and $\mathbf{5}_4$, which is inner in the direction of the curve, is formed so that it is curved more steeply toward the inside of the flow path.

Exhaust gases discharged from the exhaust ports $\mathbf{2}_1$, $\mathbf{2}_2$, $\mathbf{2}_3$ and $\mathbf{2}_4$ in the engine E are introduced into the branch pipes $\mathbf{5}_1$, $\mathbf{5}_2$, $\mathbf{5}_3$ and $\mathbf{5}_4$ of the exhaust manifold M and met together at one point in the common collecting chamber 6. Therefore, the oxygen ($O_2$) sensor S having the detecting portion Sa disposed at the one point P, i.e., the point of meeting of all the gases, can accurately detect an average concentration of oxygen ($O_2$) in all the exhaust gases and hence, a fuel supplying device can be properly controlled in order to appropriately regulate the combustion state of the engine E and the concentration of $O_2$ in the exhaust gas in response to an output signal from the $O_2$ sensor S. If the concentration of $O_2$ in the exhaust gas is appropriately controlled in the above manner, the active state of the catalytic converter C is maintained by a normal oxidizing reaction to efficiently perform the exhaust gas purifying action, when the exhaust gas is fed from the collecting chamber 6 of the exhaust manifold M to the catalytic converter C.

Moreover, the one point P is a point at which the average concentration Of $O_2$ in the exhaust gas can be detected and which is nearest to the branch pipes $\mathbf{5}_1$, $\mathbf{5}_2$, $\mathbf{5}_3$ and $\mathbf{5}_4$ and hence, the $O_2$ sensor S having the detecting portion Sa disposed at the one point P is exposed to the exhaust gas having a high temperature immediately after being passed through each of the branch pipes $\mathbf{5}_1$, $\mathbf{5}_2$, $\mathbf{5}_3$ and $\mathbf{5}_4$ and can exhibit the detecting function early because of an early activation after the start of the engine.

In addition, by the fact that the average concentration of $O_2$ in the exhaust gas can be accurately detected at the one point P, the volume of the collecting chamber 6 can be reduced, whereby the dropping of the temperature of the exhaust gas until reaching the catalytic converter C can be minimized to the utmost, thereby promoting the exhaust purifying reaction in the catalytic converter C.

Further, since those wall surfaces of the two inner branch pipes $\mathbf{5}_2$ and $\mathbf{5}_3$ which are inner in the direction of the curve and those wall surface of the two outer branch pipes $\mathbf{5}_1$ and $\mathbf{5}_4$ which are inside in the direction of the curve are formed in the above manner to ensure that the lengths of those portions of the flow path in the branch pipes $\mathbf{5}_1$ to $\mathbf{5}_4$ which are inner and outer in the direction of the curve are equal to each other to the utmost, a difference in speed between the inner portion and the outer portion of the flow path in each of the branch pipes can be minimized when the exhaust gas flows in the branch pipes $\mathbf{5}_1$ to $\mathbf{5}_4$. As a result, a more accurate average concentration of $O_2$ in the exhaust gases flowing the branch pipes can be detected by the $O_2$ sensor S.

Figure 9:
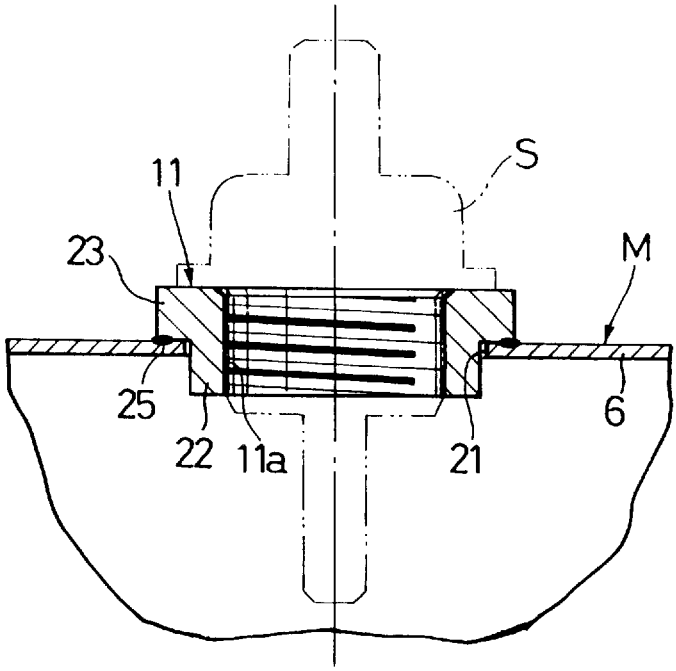
FIG. 9 is an enlarged sectional view of a sensor mounting boss shown in FIG. 6.
Figure 10:
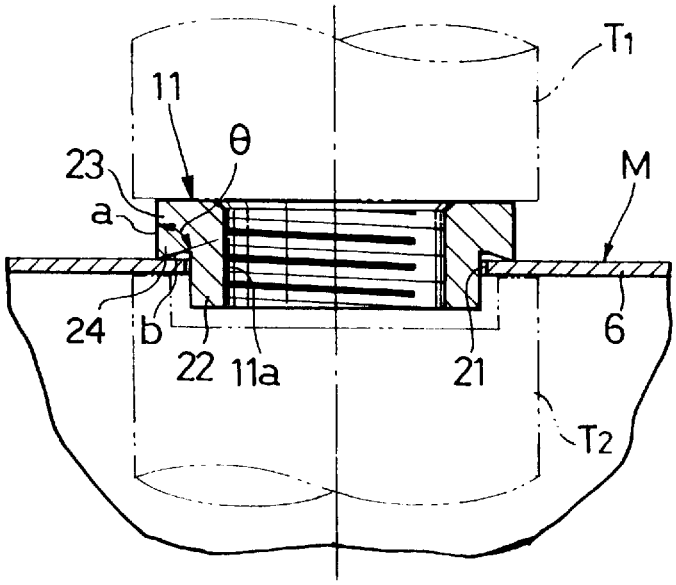
FIG. 10 is a vertical sectional view corresponding to FIG. 9, but showing the sensor mounting boss in a state immediately before a projection welding.

The sensor mounting boss 11 and the structure of welding thereof will be described below with reference to FIGS. 9 and 10.

The sensor mounting boss 11 is comprised of a smaller-diameter cylindrical portion 22 positioned and fitted in the mounting bore 21 provided in the upper wall of the collecting chamber 6, and a larger-diameter cylindrical portion 23 having a lower surface opposed to the outer surface of the collecting chamber 6 and coaxially integrally connected to the smaller-diameter cylindrical portion 22. An annular projection 24 is formed on the lower surface of the larger diameter cylindrical portion 23 to extend along an outer peripheral edge of the larger diameter cylindrical portion 23. The annular projection 24 is formed by an outer peripheral surface a of the larger-diameter cylindrical portion 23 and a tapered surface b extending at an acute angle from a lower end of the outer peripheral surface a toward the center of the larger-diameter cylindrical portion 23.

In welding the sensor mounting boss 11 to the collecting chamber 6, the smaller-diameter cylindrical portion 22 is inserted through the mounting bore 21 in the collecting chamber 6. Then, if an electric current is allowed to flow between a pair of upper and lower welding electrodes $T_1$ and $T_1$, while clamping the larger-diameter cylindrical portion 23 and the upper wall of the collecting chamber 6 by the pair of upper and lower welding electrodes $T_1$ and $T_2$, so that the annular projection 24 on the larger-diameter cylindrical portion 23 are brought into pressure contact with the outer surface of the collecting chamber 6, namely, a projection welding is conducted the annular projection 24 is molten to form a weld zone 25 between the outer peripheral edge of the larger-diameter cylindrical portion 23 and the collecting chamber 6, as shown in FIG. 9, thereby bonding the sensor mounting boss 11 to the collecting chamber 6.

Thereafter, the air-tightness of the annular weld zone 25 between the sensor mounting boss 11 and the collecting chamber 6 is examined. If an air-tightness leakage point has been found, this point can be easily and simply repaired only by providing a padding on the air-tightness leakage point by an arc welding, because the annular weld zone 25 is located at the outer peripheral edge of the larger-diameter cylindrical portion 23.

The formation of the annular weld zone 25 at the outer peripheral edge of the larger-diameter cylindrical portion 23 ensures that the strain of a threaded bore 11*a* due to a welding heat can be minimized, whereby the diameter of the threaded bore 11*a* can be increased, or the diameter of the entire sensor mounting boss 11 can be reduced.

If the apical angle θ of the annular projection 24 is acute, particularly, in a range of 20° to 70°, the melting of the annular projection 24 occurs with a relatively low welding current, and the air-tightness of the annular weld zone 25 and the reduction in electric power consumed can be provided.

Here, in order to make more clear the usefulness of the sensor mounting boss 11 according to the present invention, a problem with respect to the structure of welding of the sensor mounting boss which has been attempted hitherto, will be described below.

As shown in FIGS. 14 and 15, an attempt has been made to form a projection-welding annular projection 024 similar to a welding nut in the prior art (for example, see Japanese Utility Model Application Laid-open No. 55-122983) at a radially intermediate portion of a lower surface of a larger-diameter cylindrical portion 023 of a sensor mounting boss 11, then bring the annular projection 024 into pressure contact with an outer surface of an exhaust manifold M, and subject it to a projection-welding to form an annular weld zone 025 between the sensor mounting boss 11 and the exhaust manifold M. As a result, an air-tightness leakage has been often produced in the annular weld zone 025. Thereupon, even if an attempt has been made to provide a padding at the air-tightness leakage point by an arc welding for the repairing purpose, it has been difficult to closely connect the padding to the annular weld zone 025, because the annular weld zone 025 extending from an outer peripheral surface into a deeper portion of the sensor mounting boss 11. Eventually, it has been failed to achieve the partial repairing, and the entire outer peripheral edge of the larger-diameter cylindrical portion 023 must be welded again, which is non-efficient and uneconomical. Such a problem is solved as described above by the present invention.

FIGS. 11 and 12 illustrate another structure of welding of the sensor mounting boss 11. This structure is similar to that described in the previous embodiment, except that an annular recessed groove 26 of a V-shape in section is provided adjacent an inner side of the annular projection 24 in the lower surface of the larger-diameter cylindrical portion 23 of the sensor mounting boss 11, so that a molten slag 27 produced from the annular projection 24 upon the projection welding is accommodated in the annular recessed groove 26. In FIGS. 11 and 12, portions or components corresponding to those in the previous embodiment shown in FIGS. 9 and 10 are designated by like reference characters.

According to this embodiment, the entering of the molten slag 27 into the threaded bore 11*a* can be prevented.

FIG. 13 illustrates a further structure of welding of the sensor mounting boss 11. This structure is similar to that in the embodiment shown in FIGS. 11 and 12, except that an annular recessed groove 26 of a U-shape in section is defined in the lower surface of the larger-diameter cylindrical portion 23 in place of the annular recessed groove 26 of the V-shape in section in the above-described embodiment.

Although the embodiments of the present invention have been described in detail, it will be understood that the present invention is not limited to the above-described embodiments, and various modifications may be made without departing from the spirit and scope of the invention defined in claims. For example, the straight coupler piece 19 of the stepped superposing coupler 18 may be provided on the lower half 7B, and the stepped coupler piece 20 may be provided on the upper half 7A.

What is claimed is:

1. An exhaust manifold for an engine, comprising a manifold body which is comprised of a plurality of branch pipes and a common collecting chamber integrally connected to said branch pipes and communicating with an exhaust emission control device, a first flange plate to which said branch pipes are connected, and a second flange plate to which said common collecting chamber is connected, said first and second flange plates being disposed on planes that intersect with each other at substantially a right angle, and said manifold body being divided into an upper half and a lower half at a boundary face extending in a direction of arrangement of the branch pipes, the branch pipes extending from said first flange plate toward said second flange plate while being curved, the upper and lower halves being made of respective steel plates and welded to each other, wherein a welding mating coupler is formed by opposed outer edges of said upper and lower halves which are located at outermost positions in said direction of arrangement of said branch pipes, and a welding stepped superposing coupler is formed by opposed inner edges of said upper and lower halves facing each of clearances between adjacent ones of the branch pipes, and wherein mounting portions are provided on said first flange plate at locations between said adjacent branch pipes.

2. An exhaust manifold for an engine according to claim 1, wherein said manifold body has paddle-like reinforcing portions formed thereon to extend between and connect the adjacent branch pipes, wherein opposed wall surfaces of said upper and lower halves forming said reinforcing portions are disposed in proximity to each other at a distance such that they do not come into contact with each other even by a vibration.

3. An exhaust manifold for an engine according to claim 1 or 2, further including an exhaust gas sensor mounted to said collecting chamber for detecting a concentration of a component in an exhaust gas flowing through an inside of said collecting chamber, and all said branch pipes are formed so that their axes join together at one point within said collecting chamber, said exhaust gas sensor having a detecting portion disposed at said one point.

4. An exhaust manifold for an engine according to claim 3, wherein at least some of the branch pipes are curved so that downstream ends of the pipes are met at said one point, and at an inner wall of each of the curved branch pipes, a downstream portion is offset toward a center of a flow path in the pipe with respect to an upstream portion with an inclined portion interposed therebetween.

5. An exhaust manifold for an engine according to claim 1, or 2 further including a sensor mounting boss which is comprised of a smaller-diameter cylindrical portion positioned and fitted in a mounting bore provided in said manifold body, and a larger-diameter cylindrical portion which is coaxially, integrally connected to said smaller-diameter cylindrical portion and projection-welded at a lower surface thereof to an outer surface of said manifold body, wherein an exhaust gas sensor mounting threaded bore is provided through central portions of said smaller-diameter and larger-diameter cylindrical portions, and a projection-welding annular projection having an acute apical angle and defined in a lower surface of the larger-diameter cylindrical portion by an outer peripheral surface of said larger-diameter cylindrical portion and a tapered surface extending upwards from a lower end of said outer peripheral surface toward the center of said larger-diameter cylindrical portion.

6. An exhaust manifold for an engine according to claim 5, wherein said apical angle of said annular projection is in a range of 20° to 70°.

7. An exhaust manifold for an engine according to claim 5, wherein said larger-diameter cylindrical portion has an annular recessed groove provided in its lower surface adjacent the inside of said annular projection.

* * * * *